United States Patent [19]

Fay

[11] 4,056,233

[45] Nov. 1, 1977

[54] APPARATUS FOR PULVERIZING SOLID MATERIALS

[76] Inventor: Edwin F. Fay, West Centennial Drive, Marlton, N.J. 08053

[21] Appl. No.: 728,749

[22] Filed: Oct. 1, 1976

[51] Int. Cl.[2] ..... B02C 19/06

[52] U.S. Cl. ..... 241/39; 241/5

[58] Field of Search ..... 241/5, 39, 40

[56] References Cited

U.S. PATENT DOCUMENTS

| | | | |
|---|---|---|---|
| 2,032,827 | 3/1936 | Andrews | 241/5 |
| 2,376,747 | 5/1945 | Andrews | 241/39 |
| 2,391,723 | 12/1945 | Mann | 241/39 |
| 2,441,613 | 5/1948 | Balassa | 241/5 |
| 2,588,945 | 3/1952 | Trost | 241/39 |
| 2,763,437 | 9/1956 | Marchant | 241/39 |
| 3,602,439 | 8/1971 | Nakayama | 241/39 |

*Primary Examiner*—Granville Y. Custer, Jr.
*Attorney, Agent, or Firm*—Edelson and Udell

[57] ABSTRACT

A fluid energy mill for pulverizing to a predeterminedly desired classification or size dry solid material injected into a grinding chamber for entrainment in a high velocity vortex of a gaseous fluid established in said chamber. The grinding chamber is internally provided with a baffle located in the center of the vortex about which the heavier and coarser particles of the material are whirled at high velocity back into the vortex by the centrifugal force thereof for such further attrition of said particles prior to their discharge from the grinding chamber until they have been reduced in size and weight to their desired classification. The central baffle which may be of solid or tubular form, extends upwardly from the bottom of the chamber to a level just short of the chamber ceiling and provides a passageway extending across the top of the baffle for discharge of the finely divided particles from the top region of the grinding chamber.

7 Claims, 7 Drawing Figures

FIG. 1
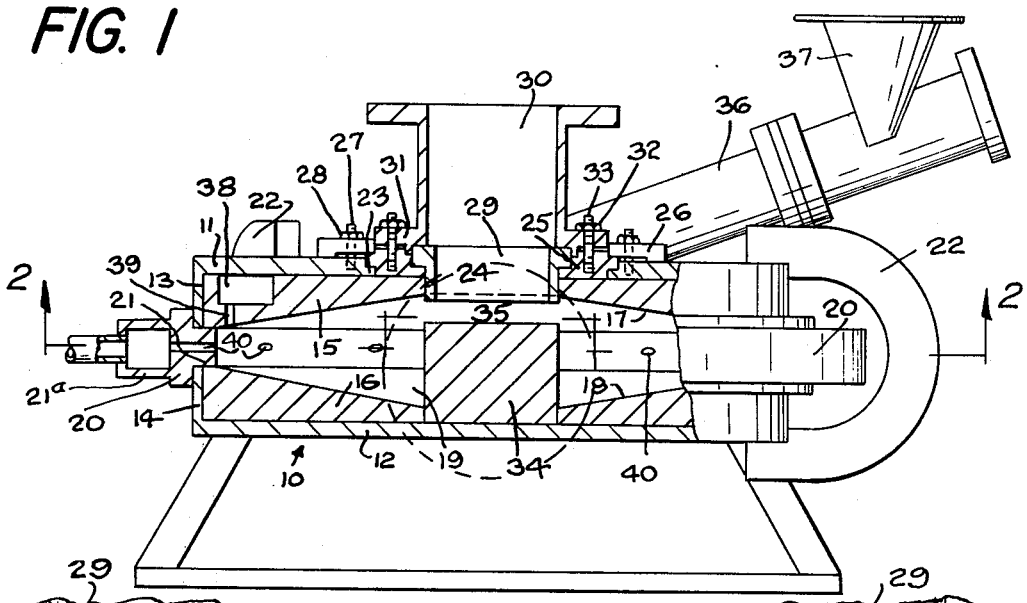
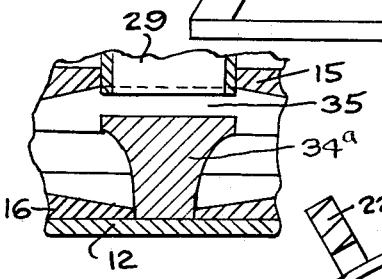
FIG.2A
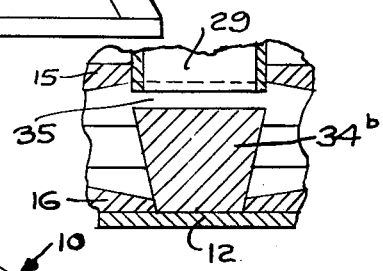
FIG.2B
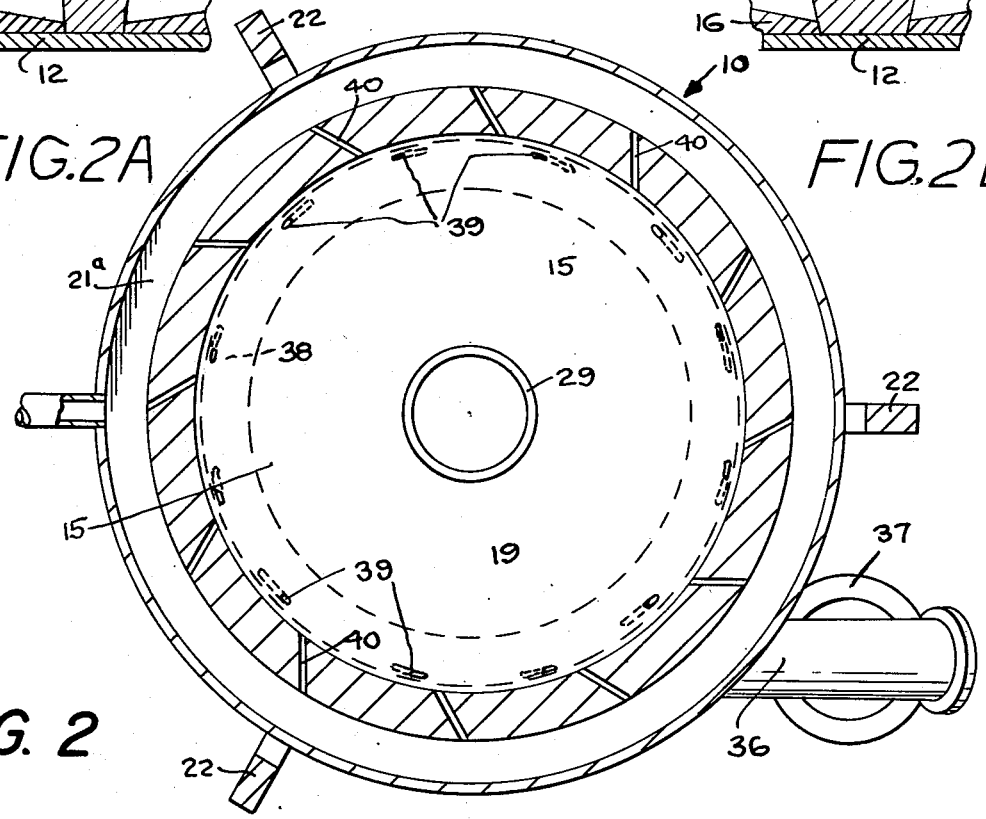
FIG. 2

FIG. 3
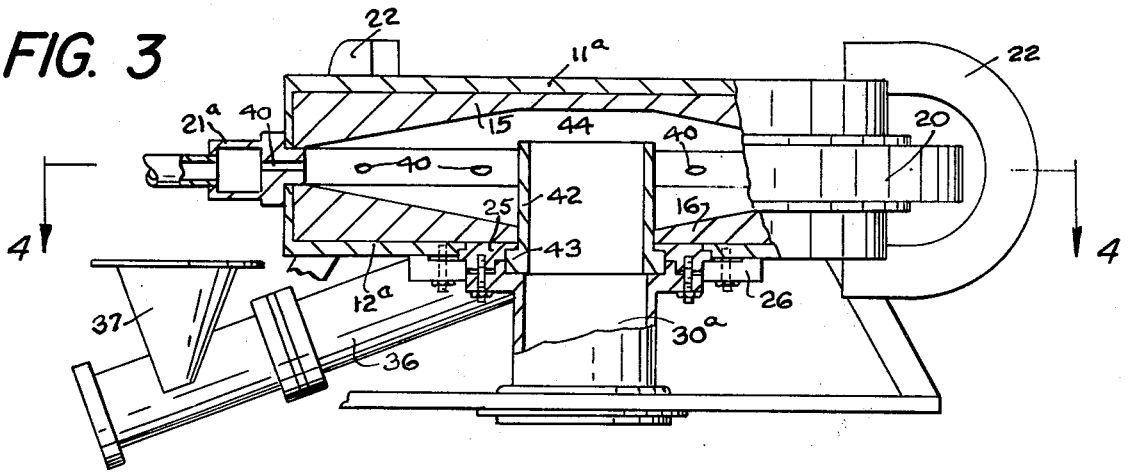
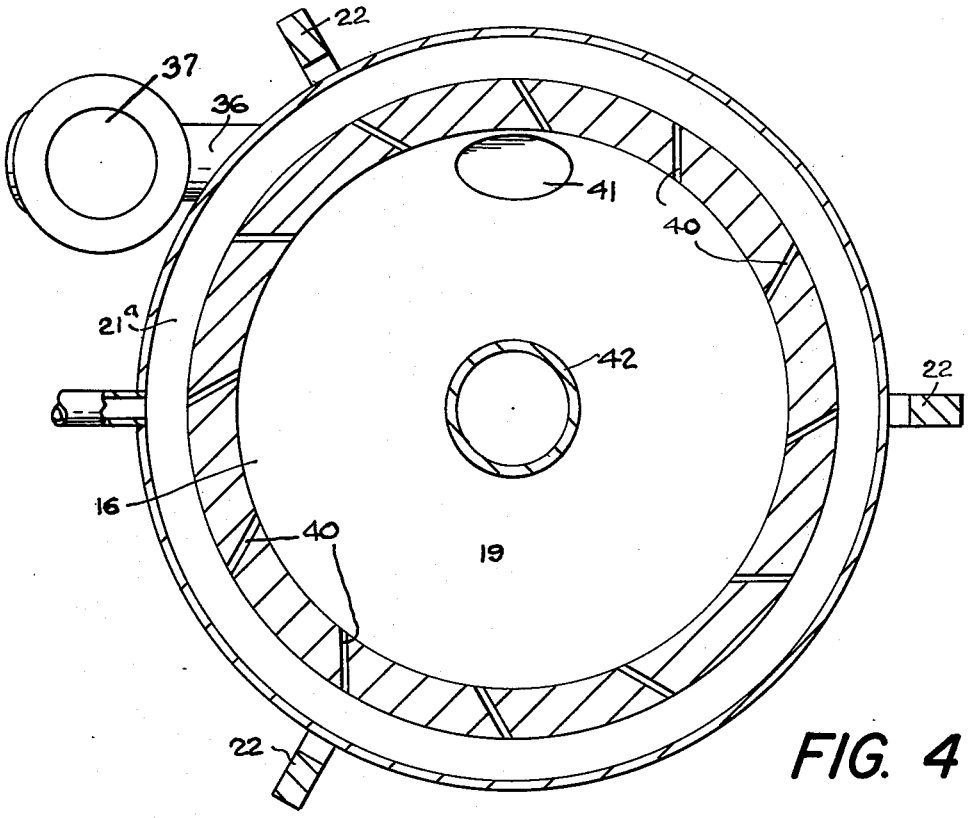
FIG. 4

APPARATUS FOR PULVERIZING SOLID MATERIALS

This invention relates generally to fluid energy mills for the pulverization of dry solid material wherein the particles of said material are reduced to a predeterminedly desired finely comminuted size through attrition caused by bombardment of the particles against one another and against the outer wall of a grinding chamber in which is established a high velocity vortex of a gaseous fluid in which the particles to be pulverized are entrained.

Such a mill is shown and described in my prior U.S. Pat. No. 3,559,895 wherein the material to be pulverized is so introduced into the high velocity energy stream as to confine and maintain the heavier and coarser particles of the raw material to a path of travel in the outer region of the gaseous vortex until such time that they were sufficiently reduced in size to be free to move inwardly of the vortex toward its center against the restraining influence of the centrifugal force of the vortex for eventual discharge from the mill.

The present invention has as its principal object to still further improve the operating efficiency and overall performance of fluid energy mills of the aforesaid character by providing means in the center of the grinding chamber for inhibiting premature discharge from the mill of those heavier and coarser particles of the material which perchance may have traversed the gaseous vortex without having been reduced to their desired classification size and effecting their re-entry into the vortex to further subject them to the grinding energy of the gaseous fluid until they have been reduced in size by attrition to their desired classification for ultimate discharge from the mill.

More specifically it is an object of the present invention to provide in the center of the grinding chamber of the mill an annular zone which is in communication with the discharge outlet of the mill only by way of a passageway leading out of the topmost region of the grinding chamber and into which the heavier and coarser particles of the material which have not been adequately reduced to their desired finely divided size gravitate for centrifugal throw of the same outwardly of said zone into the outer regions of the grinding chamber wherein they are again subjected to attrition by bombardment of the particles against one another and against the outer wall of the grinding chamber.

Still another specific object of the present invention is to provide the grinding chamber with a central baffle which intercepts and effects attrition to classified size of the heavier and coarser particles which undesirably traverse the high velocity inner reaches of the vortex without having been reduced to their desired particle size, which baffle is so operative as to maintain the intercepted particles suspended in the vortex stream under the influence of gravity until they have been sufficiently reduced in size and lightened in weight as to enable them to be lifted against the force of gravity for discharge from the topmost region of the grinding chamber.

A further object of the present invention is to provide means in the center of the grinding chamber to form an annular zone of operation of the gaseous vortex which is in communication with the discharge outlet of the mill only by way of a passageway leading from the central topmost region of the grinding chamber.

Other objects and advantages of the invention will be apparent from the detailed specification which follows, it being understood that the invention consists in the combination, construction, location and relative arrangement of parts, as described more fully hereinafter, as shown in the accompanying drawings and as finally pointed out in the appended claims.

In the accompanying drawings:

FIG. 1 is a side elevational view, partly in vertical section, of one form of the pulverizer apparatus as constructed in accordance with and embodying the principles of the present invention;

FIG. 2 is a horizontal sectional view as taken along the line 2—2 of FIG. 1;

FIG. 2A is a vertical sectional view of a modified form of the part inscribed within the broken line circle of FIG. 2;

FIG. 2B is a vertical sectional view of a further modified form of the part inscribed within the broken line circle of FIG. 2;

FIG. 3 is a side elevation, also partially in section, showing a modified form of the pulverizer apparatus of the present invention;

FIG. 4 is a horizontal sectional view as taken along the line 4—4 of FIG. 3.

In the several figures, like elements are denoted by like reference numerals.

Figure 5:
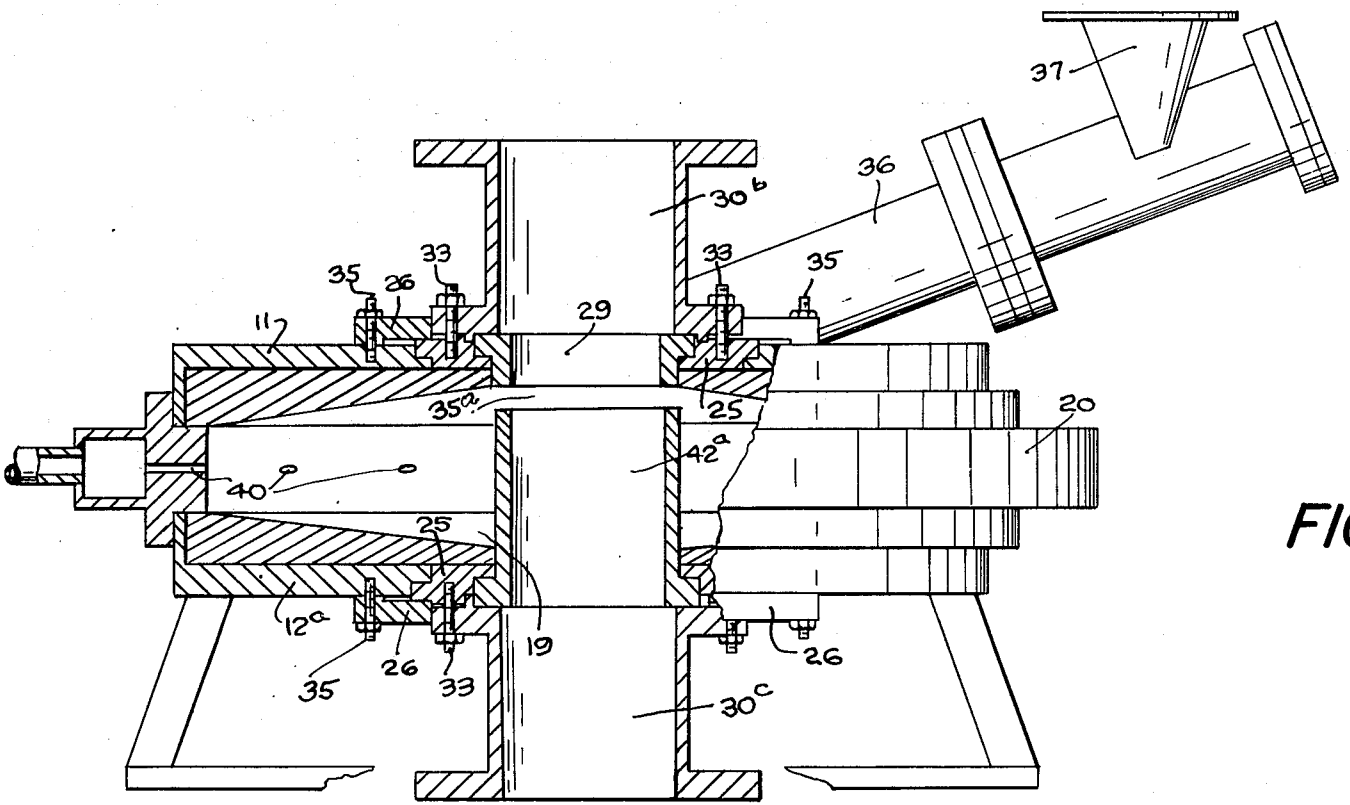
FIG. 5 is a side elevational view, partially in section, showing still another modified form of the apparatus of the present invention.

In the pulverizer of the construction and mode of operation described in my prior U.S. Pat. No. 3,559,895, the desired reduction in particle size to a specified classification is accomplished primarily by utilizing the high velocity of the energy fluid (grinding jets) to generate a centrifugal force which maintains the heavier and coarser particles of the material being pulverized in the outer region of the vortex until they have been so reduced in size by attrition as to enable them to be carried by the flow of the gaseous energy fluid inwardly toward the center of the vortex and then out of the discharge outlet with the spent gas. Greatly improved classification is obtained by so orienting the axes of the high velocity grinding jets with respect to the direction of projection of the material feed jet or jets into the pulverizing chamber as to substantially reduce any tendency of the grinding jets to effect premature dispersion of the feed jets. To this end each of a plurality of grinding jets uniformly spaced about the peripheral wall of the pulverizer grinding chamber is employed to conjointly establish therein a high velocity inwardly spiralling vortex of the energy fluid which operates to initially confine the feed material jetted into the pulverizing chamber to a path of travel closely adjoining the surrounding wall of the chamber from whence it is carried by the spiralling vortex of the grinding jets of the energy fluid to its center for ultimate discharge from the pulverizing chamber. Thus, in my prior construction of the fluid energy mill, as shown for example in FIGS. 1 to 3 and 8 of that patent, the particles of the material to be pulverized to a predeterminedly desired particle size or classification, when whirled about in the spiralling vortex at high speed are reduced or ground to the desired smaller particle size through attrition caused by the colliding and rubbing together of the substrate particles and by their abriading contact with the internal wall surfaces of the vortex chamber. However, once any of the heavier or coarser particles found their way past the outer regions of the spiralling vortex of the energy or grinding fluid, they were carried by the vortex toward its center for discharge from the pulverizer either by way of the top discharge outlet together with the more finely reduced particles and spent gas exhausting from the grinding chamber, as in the case of the mill shown in FIG. 8 of my prior patent or under the influence of gravity into a collector extending from the bottom of the mill, as in the case of the mill shown in FIGS. 1 to 3 of said patent.

The pulverizing apparatus of the present invention, while operative generally in accordance with the principles described in my prior U.S. Pat. No. 3,559,895, is modified in its internal construction to restrain premature discharge of those heavier and coarser particles of the raw material which might reach the central region of the grinding vortex in the pulverizing chamber until such time as they are sufficiently reduced in size to be carried out through the vortex discharge outlet with the spent energy fluid.

The courser particles because of their mass tend to be suspended in or gravitate down out of the rotating vortex of the gaseous fluid toward the bottom of the grinding chamber while the more finely divided particles being less influenced by the force of gravity rise upwardly through the vortex for discharge from the chamber. However, where the pulverized material is free to be discharged directly from the grinding chamber through its discharge outlet, and particularly where the discharge is effected from the bottom region of the grinding chamber, enough of the coarser particles could be discharged from the mill together with the more finely divided particles to spoil the end product.

It was found that greatly improved classification, i.e., reduction of the material being pulverized to a predeterminedly desired uniform particle size with minimum inclusion of oversized particles, is obtained when the larger particles are intercepted by a barrier located in the center of the vortex about which said larger particles may whirl and be thrown by the centrifugal force of the vortex back into the outer region of the grinding chamber for further reduction in their particle size by the attrition resulting from impact and/or abrasion between the particles themselves and abrading contact with the outer wall of the grinding chamber.

The above mentioned barrier which characterizes the present invention is so located relatively to the discharge outlet of the pulverizer and is of such circular construction coaxial with said outlet as to provide within the internal grinding chamber of the pulverizer an inner annular region in which the heavier and coarser particles which may have radially traversed the spiralling vortex of the energy fluid are restrained by gravity from entering the discharge outlet until they have been rendered light enough in weight through reduction in size of the material particles as to enable them to in a sense float upwardly out of the vortex and thence into the discharge outlet which may be disposed for either top or bottom discharge or simultaneous top and bottom discharge of the classified product from the grinding chamber.

In all forms of the present invention to be presently described in detail, the pulverizer is provided with a circular internal grinding chamber formed between a pair of suitably recessed circular heads having their marginal edges releasably secured together. Also, in all forms of the present invention, its characteristic feature is that the pulverized product issues from the topmost region of the grinding chamber and enters the discharge outlet of the pulverizer by way of a restricted space provided just above the above-mentioned circular barrier which may be either a tubular or solid member rising vertically above the bottom side or floor of the pulverizer grinding chamber in axial alinement with the central discharge outlet of said chamber.

Referring now to the drawings and more particularly to FIGS. 1 and 2, it will be observed that in this illustrated form of the present invention, the mill designated generally by the numeral 10 includes a recessed circular top plate 11 and a recessed circular bottom plate 12 which are respectively provided with oppositely presenting annular flanges 13 and 14 which circumferentially embrace and marginally define the opposed recesses of the plates 11 and 12. Respectively fitted in the recesses of these plates 11 and 12 are preformed replaceable liners 15 and 16 formed of any suitable abrasion-resistant materials, which may be any plastic material such as Teflon, nylon, polyurethane and the like or a suitable rubber, metal or ceramic material. While the exposed faces of these liners 15 and 16 are respectively shown dished, as at 17 and 18, to provide therebetween a cavity 19 which increases in vertical depth inwardly from its outer peripheral margin, in certain instances either one or both of these liners may be provided with an inner surface which is flat so as to limit vertical spread of the gaseous vortex in the grinding chamber as may be required in the case of certain materials to most effectively subject them to the grinding energy of the vortex. This cavity 19 is marginally completed by an annular member 20 having an annular radially extending inner portion 21 and an annular hollow outer portion **21*a*. The internal radially extending portion 21 of the member 20 is snugly fitted between the oppositely presenting outermost portions of the linerfitted plate members 11 and 12, while the annular outer hollow portion 21*a* is disposed in closely embracing relation about the annular flanges 13 and 14** of these plate members.

While the liner-fitted plates 11 and 12 and the intermediate annular member 20 may be secured together in their assembled relation as best shown in FIG. 1 by any suitable means, these parts are preferably releasably held assembled by a plurality of quickdetachable C-type clamps 22, to facilitate quick and easy disassembly of the mill for cleaning and otherwise servicing the same as may be required. The cavity 19 thus formed by the top and bottom plate members 11 and 12 in assembly with the intermediate annular member 20 constitutes the grinding chamber of the mill.

The top plate 11 is centrally apertured to provide it with a circular shoulder 23 in axial registry with a central aperture 24 formed in the liner 15. It will be noted that the circular shoulder 23 of the top plate 11 terminates short of the inner central portion of the liner 15 to provide the latter with a circular seat for an annular member 25 which is secured in position by a clamp ring 26 having circumferentially spaced apertures through which respectively project a series of studs 27, fixed in the plate 11, for threadedly receiving nuts 28 for holding the annular member 25 clamped to the liner 15 with the inner edge of said member 25 in registry with the inner circular edge of the liner 15. The central opening in the annular member 25 is itself circumferentially shouldered to suspend therefrom a flanged tubular member 29 which fits snugly within the central aperture 24 of the top liner 15 with the lower edge of said member 29 terminating at least substantially flush with the bottom edge of the central aperture 24 of the top liner 15. Preferably, the tubular member 29 projects into the grinding chamber slightly beyond the internal surface of the liner 15, as shown in FIG. 1. Secured to the hollow central member 29 in vertical extension thereof is a second tubular member 30 having at its bottom edge a radially extending flange 31 which overlies both the annular member 25 and the top flange of the tubular member 29, which member 30 is secured to its underlying member 25 by nuts 32 threaded onto circumferentially spaced studs 33 fixedly secured to said member 25. The hollow members 29 and 30 conjointly form a vertically extending outlet for discharge of the pulverized product from the central region of the grinding chamber of the apparatus, namely, the above mentioned cavity 19. Of course, any other suitable means may be employed for securing the vertically extending discharge outlet centrally in the top wall of the pulverizing chamber 19.

Centrally secured to the bottom plate 12 of the mill in axial registry with the vertically extending discharge outlet thereof is a solid cylindrical member 34 of a diameter which is substantially equal to the external diameter of the depending cylindrical wall portion of the member 29 which forms the inner end of the discharge outlet, it being noted that said diameter of the member 34 thus slightly exceeds the internal diameter of the inner end of said outlet. The upper edge of the member 34, sometimes referred to in this specification, as a "barrier" or as a "vortex breaker," terminates in a flat horizontally extending plane disposed in closely spaced parallel relation to the horizontal plane of the inner end of the discharge outlet. There is thus provided a restricted space 35 between the proximate ends of the discharge outlet 29–30 and the vortex breaker 34 affording passage of the pulverized material from the interior of the grinding chamber upwardly about the top circular edge of the member 34 and thence into the outlet for discharge therefrom into a collector (not shown) suitably connected to the discharge outlet.

In the form of the apparatus shown in FIGS. 1 and 2, the material to be pulverized in injected into the grinding chamber 19 by way of a feeding head, designated generally by the numeral 36, which operates in conjunction with a pressurized gaseous fluid supply to inject the raw material to be pulverized from a supply hopper 37 into the annular manifold or plenum 38 from whence said material is introduced into the grinding chamber 19 through a series of discharge ports 39 uniformly spaced circumferentially about the manifold 38, all as described in my above-mentioned prior U.S. Pat. No. 3,559,895. The feeding head 35 is similar in all material respects to that disclosed in my said patent and such disclosure is incorporated herein by reference.

The raw material thus introduced into the grinding chamber 19 and uniformly distributed about the circumferential margin of the grinding chamber is simultaneously subjected to the influence of an inwardly spiralling gaseous vortex generated and maintained at high velocity in the grinding chamber by a gaseous energy fluid, e.g., air, steam or other suitable gas, introduced at any desired temperature and pressure, usually from 100 to 150 p.s.i., through a series of uniformly spaced nozzles or jet orifices 40 which open into the grinding chamber 19 from the hollow maifold section **21*a* of the member 20 to which the energy fluid is delivered from a suitable source of supply. The jets of grinding fluid which discharge through the jet orifices 40, which latter may be of any desired uniformly spaced number relatively to the number of the material feed ports 39,** are so oriented as to constrain the injected raw feed material to move in a circle immediately adjoining the circular wall of the grinding chamber so that the heavier and coarser particles of the material are initially reduced in size by collision against one another and against the wall of the grinding chamber until they have been sufficiently reduced in size to relieve them from the influence of the centrifugal force of the gaseous vortex and permit their movement inwardly toward the center of the vortex.

In operation of the pulverizer mill having the centered vortex breaker 34 as above described, the heavier and coarser particles which are being carried inwardly from the outer region of the vortex toward the center thereof tend to drop under the force of gravity toward the bottom of the grinding chamber in the annular zone immediately surrounding the breaker 34, leaving for discharge through the outlet only such particles of reduced size and weight as may be carried out of the outlet with the gaseous fluid discharged therefrom. Since the rotational velocity of movement of the particles entrained in the vortex progressively increases as they advance toward the vortex center, the centrifugal force developed in the zone surrounding the barrier 34 is of an order sufficient to throw the heavier particles whirling about said barrier back into the outer reaches of the vortex where they are attrited to further reduced size by collision between the particles themselves and rubbing contact with the walls of the grinding chamber. Some attrition is also obtained by frictional engagement of the particles with the external wall surface of the barrier 34 as the particles whirl thereabout.

The particles of material are thus reduced to such size and weight as enables them to be lifted by the spiralling vortical stream of the pressurized grinding fluid against the force of gravity to the central topmost region of the grinding chamber, i.e., above the top end of the vortex breaker, for discharge from the mill by way of the space 35 and the discharge outlet 29–30 communicating therewith.

FIGS. 2A and 2B respectively illustrate modified forms of the solid barrier or vortex breaker 34, both of which modifications are designed to favor movement of those larger particles of the material undergoing pulverization to their desired classified size downwardly toward the bottom or floor of the grinding chamber in the zone immediately surrounding the barrier. Thus, in the modification of FIG. 2A the solid barrier **34*a*** may be of a circular configuration having a vertically curved outer surface which progressively decreases in diameter downwardly from the top toward the bottom end of the barrier, which curved surface serves to deflect the oversized particles suspended in the vortex whirling about the barrier downwardly toward the bottom of the grinding chamber from whence they are re-introduced into the vortex and so further subjected to the grinding energy of the vortex fluid as hereinbefore described.

FIG. 2B shows a further modification of the barrier, therein designated **34*b*, in which it is substantially in the form of an inverted truncated cone having a downwardly sloping circular surface the diameter of which progressively decreases toward its bottom end. As in the modification of FIG. 2A the downwardly sloping circular surface of the barrier or vortex breaker 34*a* of FIG. 2B provides a deflecting surface which directs and so assists the force of gravity to draw the oversized particles of the material toward the bottom of the grinding chamber against their premature discharge from the mill. It will be noted that in all of the illustrated forms of the solid barrier, its top end is of a diameter substantially equal to the external diameter of the inner end of the discharge outlet of the mill and that said top end of the barrier is flat and lies in a horizontally extending plane disposed in closely spaced parallel relation to the horizontal plane of said inner end of the discharge outlet to provide the restricted passageway 35** hereinbefore mentioned.

FIGS. 3 and 4 show a modified construction of the pulverizing mill embodying the principles of the present invention. In this modification, the raw feed material to be pulverized is injected into the grinding chamber through a single port 41 oriented to direct the material to flow along a path substantially tangential to a circle closely adjacent the circumferentially extending outer wall of the grinding chamber, the single jet of the feed material so introduced into the grinding chamber being thus embraced on its outer side by the circular wall of the grinding chamber and on its inner side by the jets of the pressurized grinding fluid which issue from the ports 40 to establish the high velocity inwardly spiralling gaseous vortex into which is introduced the raw material to be pulverized.

The mill of FIGS. 3 and 4 also differs from that of FIGS. 1 and 2 in that its material feeding head 36 is connected into the bottom head 12*a* of the mill rather than into its top head 11 for injecting the raw material into the grinding chamber.

Still another and major difference between the mills of FIGS. 1 and 3 is that in this modified construction the vortex breaker or barrier 42 is of a hollow instead of a solid cylindrical form and is centrally secured to the bottom instead of to the top head of the grinding chamber as an inwardly presenting extension of a discharge outlet which extends outwardly from the bottom head of the grinding chamber instead of from the top head thereof as in the previously described construction. The tubular vortex breaker 42 is flanged, as at 43, for securement to the bottom head of the mill and to the discharge outlet 30 associated therewith as an extension thereof in the same manner as that employed for securement of the member 29 and its associated discharge outlet 30 to the top wall of the mill shown in FIG. 1.

As in the case of the solid barrier or vortex breaker of the FIG. 1 construction, in this modified construction of FIG. 3, the tubular barrier 42 extends upwardly into the grinding chamber 19 from the bottom wall thereof to a level closely spaced from the completely closed top wall of the grinding chamber to provide a passageway 44 of restricted depth between said top wall and the upper end of the vortex breaker for flow of the pulverized material from the grinding chamber with the exhausting gaseous fluid into the open end of the tubular breaker for discharge through the latter and its associated bottom discharge outlet to a suitable collector (not shown).

The operating principles of the mill employing the tubular form of vortex breaker as just described are the same as those for the mill employing the solid breaker, the only difference being that by use of the tubular form of the vortex breaker or barrier the finely divided particles which by reason of their reduced weight are able to rise in the gaseous vortex against the force of gravity to the topmost region of the grinding chamber, i.e., above the top edge of the tubular breaker, may then be discharged from the bottom of the mill by way of the hollow interior of said breaker which serves as an internal extension of the bottom discharge outlet.

It will be understood that it is within the contemplation of the present invention that the material pulverized to a desired classification within the grinding chamber which includes the solid form of vortex barrier 34 for discharge of the final product from the top of the chamber, as in the construction shown in FIG. 1, may be effected by injection of the raw material into the grinding chamber by a material feeding head, such as that designated 36, which is connected to the bottom side of the mill instead of to the top side as shown, and that such feeder, whether top or bottom mounted, may inject the raw material into the grinding chamber through a plurality of injection ports 40 as shown in FIGS. 1 and 2 or through a single injection port 41 as shown in FIGS. 3 and 4.

Similarly, in mills designed for bottom discharge of the final product by utilization of the hollow form of vortex breaker as shown in FIG. 3, the feeder 36 may likewise be connected to the top side of the mill, instead of to the bottom side as shown, for injection of the raw material into its grinding chamber by way of a plurality of ports 39 as shown in FIG. 1 or a single port 41 as shown in FIG. 3.

FIG. 5 illustrates the application of the present invention to a pulverizing mill having provision for simultaneous discharge of the pulverized material by way of discharge outlets extending from both the top and bottom heads of the mill. It will be noted that for such simultaneous discharge of the material through the top and bottom heads of the mill, the vortex breaker 42*a* must be of the tubular construction fitted in the bottom wall of the grinding chamber as shown in FIG. 3. However, instead of the top head of the mill being completely closed, as in the mill of FIG. 3, its top head is provided with a top discharge outlet 30*b* similar to the top discharge outlet 30 of the FIG. 1 form of the mill, which top discharge outlet is in axial alinement with the bottom discharge outlet formed of the tubular members 30*c* and 42*a* as in the construction of FIG. 3 but with its inlet end spaced from that of the top outlet by the restricted 360° open passageway 35*a*.

As in the case of the constructions shown in FIGS. 1 and 3, it will be understood that in the mill of the construction shown in FIG. 5 the material feeding head 36 may be connected to the bottom head of the mill instead of into the top head as shown and that the raw material may be injected into the grinding chamber through a plurality of circumferentially spaced ports as in the construction of FIGS. 1 and 2, or through a single port as in the construction of FIGS. 3 and 4.

In all of the constructions above described, the inner end of the cylindrical baffle or vortex breaker, i.e., the solid member 35 of FIG. 1, the tubular member 42 of FIG. 3 and the tubular member 42*a* of FIG. 5, extends to a point short of the top ceiling of the grinding chamber to provide the restricted passageways respectively designated 35, 44 and 35*a* in FIGS. 1, 3 and 5. It will be noted that these restricted passageways each provide a 360° entrance into the discharge outlet with which it is in communication and it has been found that for optimum results the vortex breaker should extend vertically from the floor of the grinding chamber to a level substantially above the horizontally extending median plane of the chamber to thereby provide in the center of the vortex a cylindrical surface of sufficient height to prevent premature discharge of the heavier and coarser particles which would otherwise reach the center of the gaseous vortex whereat the rotational velocity of the vortex was sufficiently great to overcome the force of gravity acting upon such particles and thus be carried thereby into the discharge outlet of the mill together with the exhausting gaseous fluid of the vortex. The vortex breaker thus provided in the center of the grinding chamber of the mill forms in effect an annular pocket or zone spaced radially away from the vortex center from which the heavier and coarser particles of the material, while still gravitationally suspended in the vortical stream, are centrifugally thrown back into the outer regions of the vortex until they have been sufficiently reduced in size and concomitantly reduced in weight by attrition to rise against the force of gravity into the topmost region of the grinding chamber for discharge from the mill by way of the 360° entrance to the discharge outlet as above described.

It will be understood that various changes and modifications in the construction of the mill may be made from time to time without departing from the general or real spirit of the present invention. Thus, in the case of the mills shown in FIGS. 1 and 3 the tubular members which conjointly constitute the top discharge outlet of the mill may be in the form of a single member having its inner end fitted in the top head of mill by any desired suitable means, while in the constructions of the mill as shown in FIGS. 3 and 5, the externally projecting bottom discharge outlet members may be formed as integral extensions of the tubular vortex breaker which extends into the interior of the grinding chamber as shown and hereinbefore described. Accordingly, it will be understood that it is intended to claim the invention broadly, as well as specifically, as indicated by the appended claims.

What is claimed as new and useful is:

1. Apparatus for the pulverization of solid material into finely divided form comprising a generally circular grinding chamber for the particles to be pulverized formed between a pair of top and bottom heads, means for injecting a pressurized gaseous fluid into said chamber to establish therein a high velocity inwardly spiralling vortex of the gaseous fluid, means for injecting the material to be pulverized into said grinding chamber for entrainment of said particles of material into the outer reaches of said vortex for movement inwardly thereof toward a discharge outlet coaxial with the center of the vortex, and baffle means including a fixed member disposed centrally within the grinding chamber in axial alinement with said discharge outlet and extending vertically from the floor of said grinding chamber substantially beyond the horizontal median plane of said chamber to a level short of and in relatively closely spaced relation to the top head of said chamber, said baffle member having an external surface defining the inner wall of an annular zone within said grinding chamber which is closed at its bottom end and open at its top end, the top end of said baffle member having an outline defining a cross-sectional area which is at least substantially as great as that of the bottom end of said member and said inner wall of said annular zone being radially unobstructed across the top thereof and of a cross-sectional area at least equal to that of the inlet end of said discharge outlet to provide an unobstructed free space of vertically limited depth located between said topmost end of said baffle member and the top head of said grinding chamber, said space extending across said topmost end of said annular zone inner wall for unrestricted direct communication with said zone about the full peripheral extent of said wall, whereby those heavier and coarser particles of material which have traversed said vortex and are gravitationally held in said zone are centrifugally thrown back into said vortex and subjected thereby to its grinding energy until the same have been reduced in size by attrition in said zone and so are sufficiently lightened in weight to be lifted out of said zone against the force of gravity for discharge solely from the upper region of the grinding chamber together with the exhausting stream of said gaseous vortex radially inward across the top end of said baffle member into said discharge outlet.

2. Apparatus for pulverizing solid materials according to claim 1 wherein the bottom head of said chamber is completely closed and said discharge outlet is located centrally in the top head of said grinding chamber with its inlet end in communication with the interior of said chamber and wherein said baffle means is in the form of a solid member having a circular top end spaced from said inlet end of the discharge outlet to provide a restricted passageway leading from the interior of said grinding chamber into said discharge outlet across the full circular extent of the top end of said cylinder.

3. Apparatus for pulverizing material according to claim 2 wherein said solid baffle member is of a circular cross-section the diameter of which progressively decreases downwardly from the top end thereof.

4. Apparatus for pulverizing material according to claim 3 wherein said solid baffle member is of a circular cross-section having its external surface vertically curved downwardly and inwardly relatively to its vertical axis.

5. Apparatus for pulverizing material according to claim 3 wherein said baffle member is substantially in the form of an inverted truncated cone.

6. Apparatus for pulverizing solid materials according to claim 1 wherein the top head of said chamber is completely closed and said discharge outlet is located centrally in the bottom head of said grinding chamber with its inlet in communication with the interior of said chamber and wherein said baffle means is in the form of a tubular member having its bottom end sealed in the bottom end of said chamber as an inner extension of said discharge outlet, said member having a circular open top end inwardly spaced from the closed top head of the grinding chamber to provide a passageway leading from the interior of said grinding chamber into said discharge by way of the bore of said tubular member, said passageway being open for communication between the interior of said grinding chamber and said bore of said tubular member across the full circular extent of the top end of said tubular member.

7. Apparatus for pulverizing material according to claim 1 wherein said top and bottom heads of said grinding chamber are respectively provided centrally therein with oppositely projecting axially alined discharge outlets in communication with one another and wherein the bottom discharge outlet is extended upwardly into the interior of the grinding chamber to provide an open inlet end which is disposed substantially above the horizontal median plane of the grinding chamber to provide within the top region of said chamber a common passageway between the inlet ends of said oppositely extending axially alined discharge outlets which opens into the interiors of discharge outlets across the full circular extent of the inlet end of said bottom discharge outlet whereby the pulverized material may be discharged only from the top region of said grinding chamber simultaneously through both of said top and bottom discharge outlets.

* * * * *